United States Patent [19]

Barris et al.

[11] 4,183,174

[45] Jan. 15, 1980

[54] TOY STUNT VEHICLE

[76] Inventors: George Barris, 10811 Riverside Dr., North Hollywood, Calif. 91602; Leslie Turbowitz, 175 Prospect St., East Orange, N.J. 07016

[21] Appl. No.: 917,808

[22] Filed: Jun. 22, 1978

[51] Int. Cl.[2] ..... A63H 30/04

[52] U.S. Cl. ..... 46/254; 46/210; 46/211

[58] Field of Search ..... 46/253, 254, 255, 256, 46/248, 249, 251, 201, 202, 206, 210, 211, 213, 262

[56] References Cited

U.S. PATENT DOCUMENTS

| | | | |
|---|---|---|---|
| 3,445,959 | 5/1969 | Barlow et al. | 46/262 |
| 3,757,459 | 9/1973 | Buck et al. | 46/202 |
| 3,772,824 | 11/1973 | Terzian et al. | 46/206 |
| 3,803,756 | 4/1974 | Strongin | 46/202 |
| 3,822,880 | 7/1974 | Terzian et al. | 46/251 X |
| 4,073,087 | 2/1978 | Ieda | 46/202 |

*Primary Examiner*—Louis G. Mancene
*Assistant Examiner*—Mickey Yu

[57] ABSTRACT

A self-propelled, four-wheeled vehicle is disclosed in which one of the rear wheels is motor driven, and the other rear wheel is arranged to be free-wheeling. Depending upon the selected drive torque transmitted to the single driven wheel, the vehicle either moves straight and level, or performs a wheel stand while moving circularly. A user can select the desired vehicle motion from a remote location.

5 Claims, 4 Drawing Figures

FIG. 3
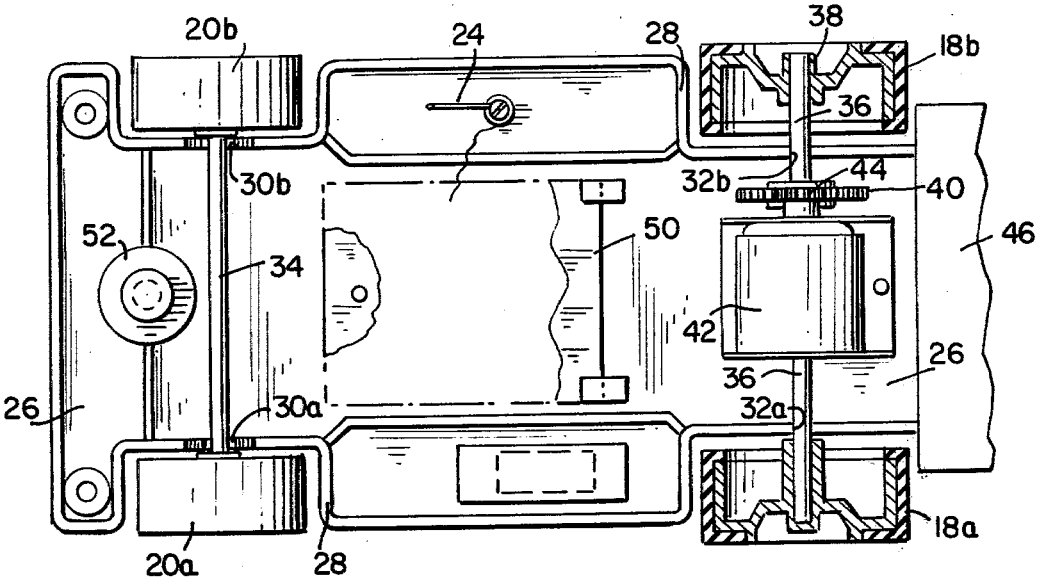
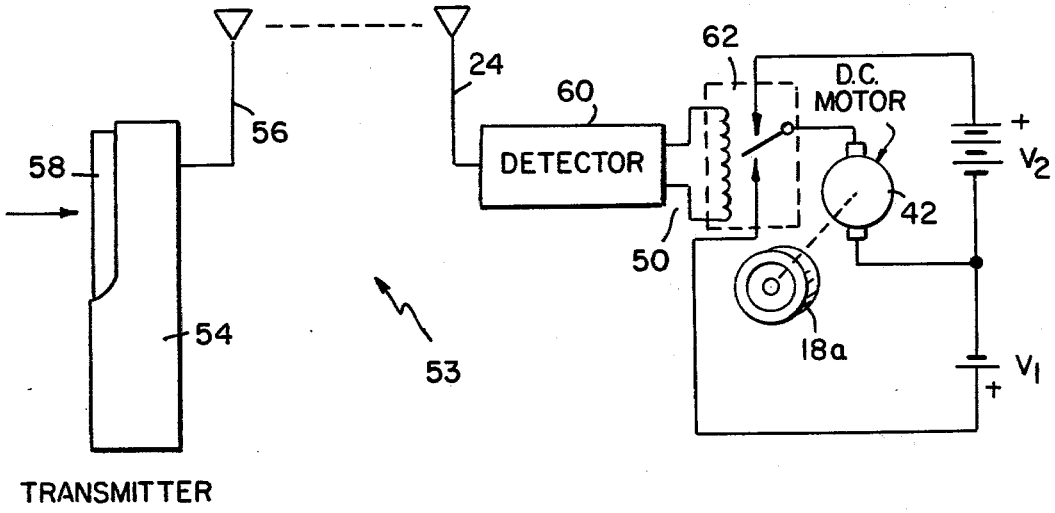
FIG. 4

TOY STUNT VEHICLE

DESCRIPTION OF THE INVENTION

This invention relates generally to toy vehicles, and more particularly to such vehicles capable of performing wheel stands or so-called "wheelies."

Toy vehicles capable of performing wheel stands or "wheelies" are known in the art, examples appearing in U.S. Pat. Nos. 3,757,459 and 4,073,087. Both of these patents disclose toy vehicles which stand upwardly on their rear wheels to perform a wheelie after being accelerated a sufficient amount. However, neither of these patented vehicles is designed to move other than forwardly while performing a wheel stand, the vehicle of the '459 Patent including a trailing leg for engaging a track to ensure lateral stability of the vehicle when its forward wheels are raised above a running surface. Therefore, these prior vehicles cannot be controllably steered during their operation, thus requiring a user to follow after them for purposes of retrieval. Accordingly, a vehicle which is capable of performing wheelies and which may also be steered, as by remote control, is not suggested by the known prior art.

It is therefore an object of the present invention to overcome the above and other shortcomings in the prior art wheelie vehicles.

It is another object of the present invention to provide a toy stunt vehicle which can be remotely controlled.

It is still another object of the present invention to provide a toy vehicle capable of performing "wheelies" and which is also steerable.

It is yet another object of the present invention to provide a toy stunt vehicle which is of basically simple construction so as to provide a great user enjoyment at a minimum of expense.

In accordance with a specific embodiment of the present invention, a stunt vehicle comprises a body having a pair of wheels rotatably mounted to its rearward portion. One of the wheels is driven by a motor at a selected torque while the other wheel is free to idle or "free-wheel." The motor is controlled to deliver the selected driving torque to the driven wheel. The vehicle center of gravity is located so that its body is levelly propelled when a first driving torque is selected and the vehicle performs a wheel stand while moving circularly when a second, greater driving torque is selected.

The present vehicle preferably includes another pair of wheels mounted to its forward portion for rotation about a common axis transverse to the body to enable the vehicle to move in a straight path when the first driving torque is selected.

The above brief description, as well as further objects, features and advantages of the present invention will be more fully understood by reference to the following detailed description of the presently preferred, but nonetheless illustrative embodiment, in accordance with the present invention, when taken in conjunction with the accompanying drawings, wherein:

FIG. 3 is a top plan view, partly in section, of the present vehicle; and

FIG. 4 is a schematic block diagram of a remote control system for operating the vehicle of the present invention.

Figure 1:
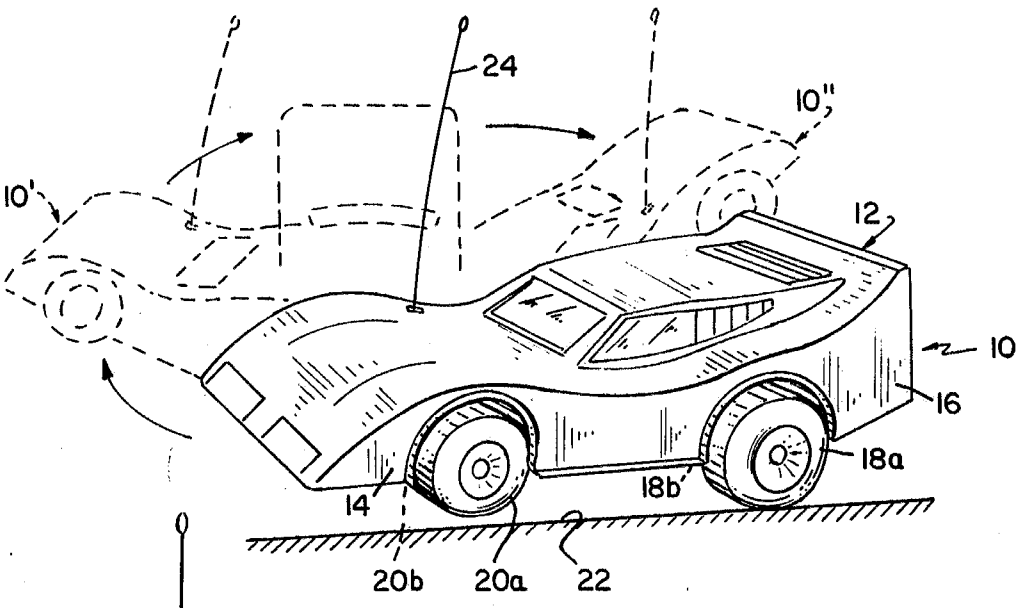
FIG. 1 is a perspective view of the present vehicle while undergoing a circular wheel stand.

Referring now in detail to the drawings and particularly to FIG. 1 thereof, in accordance with an illustrative embodiment demonstrating objects and features of the present invention, there is provided a vehicle generally designated by the reference numeral 10. The vehicle 10 generally includes a body 12 which is preferably molded of plastic and has a forward portion 14 and a rear portion 16. A pair of wheels **18*a* and 18*b* are rotatably mounted to the rear portion 16 of the vehicle body 12, and another pair of wheels 20*a* and 20*b* are preferably rotatably mounted to the front portion 14 of vehicle body 12. It is also preferred that all of the vehicle wheels be surrounded by a flat rubber tire to obtain sufficient traction against a substantially level running surface 22. The vehicle body 12 may also include a whip antenna 24** extending upwardly therefrom in the event of remote control operation, as described later below.

FIG. 1 also illustrates the present vehicle 10 performing a wheel stand, known popularly as a "wheelie," and simultaneously moving in a circular path about its right rear wheel **18*b*. The vehicle shown in outline at 10' after beginning its circular "wheelie" motion, and at a later position 10" which is about halfway through the vehicle's circular path of movement before it returns to its starting position. Of course, the present vehicle 10 can also be operated so that its body 12 moves straight ahead and level with respect to the running surface 22. As will be later described, the vehicle 10** may also be steered in the direction of its above circular path, so that it can be made to eventually return to a user who desires to remain stationary.

Further details of the present vehicle 10 will now be explained with reference to FIGS. 2 and 3.

Vehicle body 12 is preferably mounted atop a lower frame or platform 26 which is also preferably formed of molded plastic. Platform 26 has an upward extending lip 28 formed contiguously about its outer perimeter, the lip 28 having recesses **30*a*, 30*b* and 32*a*, 32*b* formed therein for receiving forward and rearwar axle shafts 34 and 36, respectively. These recesses are configured to enable smooth rotation of the shafts 34, 36 therein, and are formed at opposed locations along the lip 28 so that each of the axle shafts is substantially transversely oriented relative to the vehicle body 12**, as shown in FIG. 3.

Wheel **18*a* is fixedly joined at one end of the shaft 36 as by a press fit, and wheel 18*b* is mounted at the other end of the shaft 36 for smooth pivotal movement. The wheel 18*b* is preferably retained on the shaft 36 by a lock ring 38, as shown in FIG. 3. It will be appreciated that the wheel 18*b* is free to rotate, or to "free-wheel" about the shaft 36, whereas wheel 18*a* will always rotate along with the shaft 36**.

The wheels **20*a* and 20*b*, at the forward portion of the vehicle body, are each preferably fixedly joined, as by press fitting, to respective ends of the axle shaft 34. The shaft 34 being free to rotate within the recesses 30*a* and 30*b*, the wheels 20*a* and 20*b* accordingly are free to rotate together. As the wheels 20*a* and 20*b* will rotate together at the same speed by way of the common axle shaft 34, the vehicle body 12 will move in a substantially straight forward direction in response to rotation of the one driven wheel 18*a*, as long as wheels 20*a* and 20*b* maintain sufficient traction with the running surface 22**.

Continuing now with reference to FIG. 3, a motor drive mechanism is provided for wheel 18*a*, this mechanism including a pinion gear 40 axially joined to the axle shaft 36 at a location intermediate the ends of the shaft. A DC electric motor 42 is fixedly mounted to the vehicle body platform 26 and has a driving gear 44 which operatively engages the pinion gear 40 about the axle shaft 36. Motor 42 is conventional and is preferably of the type which can provide a desired driving torque to the wheel 18*a* via the gears 40 and 44 and shaft 36, depending upon the amount of current supplied to the motor 42 from a power source such as one or more batteries. By this construction, it will be understood that rotational movement from the motor 42 is provided to the wheel 18*a* at a desired level of torque, while the shaft 36 does not transmit driving torque to the wheel 18*b* owing to the pivotal mounting of wheel 18*b* on the shaft 36.

Figure 2:
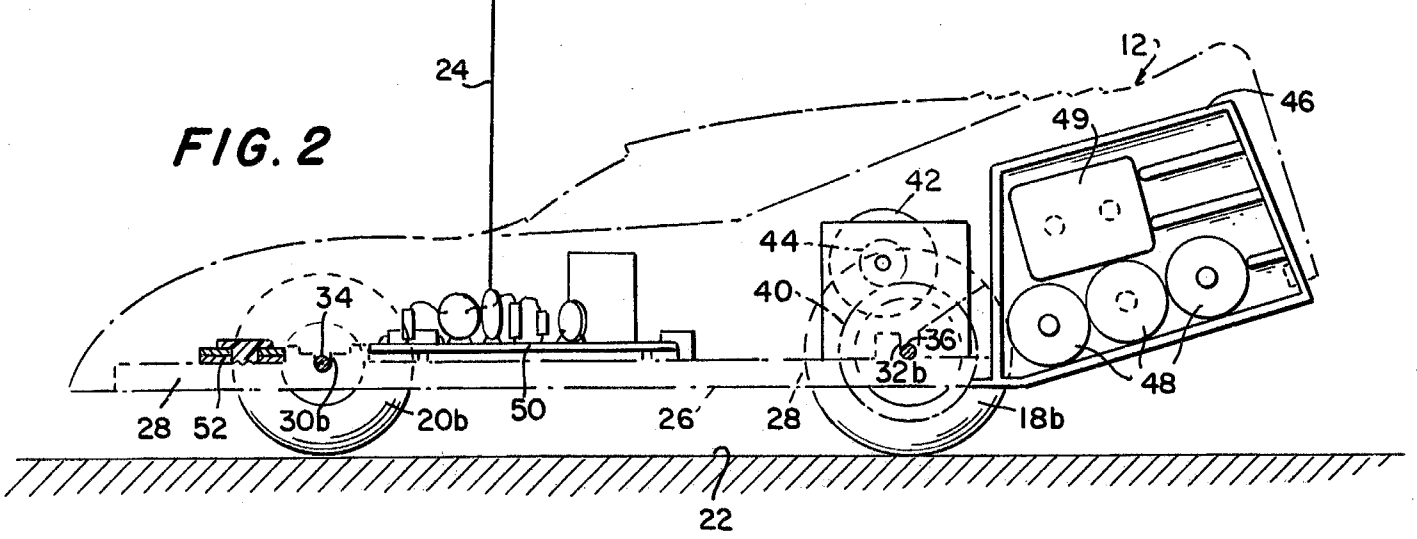
FIG. 2 is a side elevational view, in outline form, showing interior components of the present vehicle.

In the preferred embodiment, the present vehicle 10 is constructed to carry a battery power source for the motor 42, the batteries to be contained within a compartment 46 formed within the vehicle body 12, as shown in FIG. 2. These batteries may comprise a number of penlight cells 48, the particular connection of the cells 48 to the motor 42 being explained in greater detail later in connection with FIG. 4. Compartment 46 also contains an additional battery 49 for powering an electronic remote control unit 50 secured to the platform 26.

As will be explained later in connection with FIG. 4, remote control unit 50 operates to actuate the motor 42 to provide a selected driving torque to the wheel 18*a*.

From the foregoing description, it will be understood that when the vehicle 10 is operated, its body 12 is heavily weighted at its rear portion 16 owing to the batteries within compartment 46 and the motor 42. Such body weight distribution contributes to the ability of the present vehicle 10 to perform its wheel stand maneuver, as it is important for the center of gravity of the vehicle body 12 to be just slightly forward of the axle shaft 36. This enables the torque delivered to the wheel 18*a* to act on the vehicle body 12, including the platform 26, so as to cause the forward body portion 14 to be raised upwardly thereby lifting the wheels 20*a* and 20*b* from the running surface 22 (FIG. 1). As noted earlier, once wheels 20*a* and 20*b* are free of engagement with the running surface 22, the vehicle will be circularly propelled about its idling wheel 18*b* by the driven wheel 18*a*.

In order that the forward body portion 14 not be raised to too great a height such as might cause the vehicle 10 to overturn during operation, a weight 52 in the form of one or more metal washers is fixedly mounted to the forward portion of the body platform 26, as shown in FIGS. 2 and 3. The weight 52 should be great enough to prevent excessive upward movement of the forward body portion 14 but light enough to allow the wheels 20*a* and 20*b* to be raised from the running surface 22 when the desired driving torque is provided to the wheel 18*a*.

The present vehicle 10 is capable of being steered in the direction of its circular "wheelie" movement. As the "wheelie" maneuver can be stopped at any time before the vehicle 10 completes one entire revolution, the vehicle will then move straight ahead in a direction different from the one in which it moved prior to the maneuver.

The above steering feature of the present vehicle 10 makes it desirable to remotely control the vehicle as by a radio or sound signaling system. In the preferred embodiment, vehicle 10 is remotely controlled with the aid of a conventional, hand held radio transmitter device which emits a continuous wave signal upon a user's command. This allows the user to select one of two driving torques for the wheel 18*a* and thereby cause the vehicle 10 to move either straight and level, perform a circular wheel stand maneuver, or to steer by causing the vehicle 10 to wheel stand momentarily as described above.

Referring now to FIG. 4, a preferred remote control system 53 for the present vehicle 10 is illustrated in block form. The system 53 includes a hand held transmitter 54 which emits a continuous wave radio signal of given frequency from a whip antenna 56 in response to depression of a push button 58 by the user. Located at the vehicle 10 is the receiving portion of the system, which includes the vehicle whip antenna 24 and the control unit 50. As seen in FIG. 4, control unit 50 includes a detector 60 which is responsive to the signal transmitted by the hand held transmitter 54, and a relay 62 which is energized by the detector 60 in response to the radio signal. The relay 62 operates to energize the DC motor 42 by voltage source $V_1$ when no signal is received by the detector 60, and to energize the motor 42 by another voltage source $V_2$ when a signal is received.

Voltage sources $V_1$ and $V_2$ may comprise different combinations of the penlight cells 48 within the vehicle battery compartment 46. For example, source $V_1$ may consist of a single penlight cell, while source $V_2$ may include two penlight cells in series so as to provide about twice the current to the motor 42 and, hence, about twice the driving torque to the wheel 18*a*, when a signal is received by the detector 60 as compared to a no-signal condition.

From the foregoing, it will be understood that the remote control system 53 can operate to allow the vehicle 10 to move straight ahead and level with respect to the running surface 22 when no signal is radiated by the transmitter 54, i.e., button 58 is in an up position; and to cause the vehicle 10 to perform a circular wheel stand when a signal is radiated, i.e., button 58 is depressed. The effective range of the remote control system 53 will, of course, be determined by the relative sizes of the antennae 24 and 56, as well as the power level of the radio signal produced by the transmitter 54. In the preferred embodiment, both the transmitter 54 and the detector 60 are each powered by a standard nine-volt battery. With the detector 50 being of the regenerative type, the outdoor effective range of the remote control system is about 30 feet (9.1 meters) when operating at a frequency of about 27 Mhz.

As will be readily apparent to those skilled in the art, the present invention may be realized in other specific forms without departing from its spirit or essential characteristics. The present embodiment is, therefore, to be considered as illustrative and not restrictive, the scope of the invention being indicated by the claims rather than by the foregoing description, and all changes which come within the meaning and range of equivalents of the claims are therefore intended to be embraced therein.

What is claimed is:

1. A stunt vehicle comprising a vehicle body having a forward portion and a rearward portion; a pair of wheels rotatably mounted to the rearward portion of said body; motor drive means coupled to one of said wheels for driving said one wheel with a selected torque, the other wheel being free to idle; and control means coupled to said motor drive means for actuating said motor drive means to provide a selected one of a first driving torque and a greater second driving torque to said one wheel; the center of gravity of said vehicle being located so that said body is level when propelled by said one wheel when said first driving torque is selected, and the forward portion of said vehicle body is raised upwardly and said vehicle is circularly propelled by said one wheel about said other wheel when said second driving torque is selected.

2. A vehicle according to claim 1, further including at least one front wheel mounted for rotation to the forward portion of said body so that said vehicle body is guided by said front wheel and said rear wheels when said first driving torque is selected.

3. A vehicle according to claim 2, further including selector means remote from said vehicle for enabling a user to select either one of said first and second driving torques.

4. A vehicle according to claim 1, further including another pair of wheels mounted to the forward portion of said body for rotation about a common axis transverse to said body so that said vehicle body moves in a straight path on both said pairs of wheels when said first driving torque is selected.

5. A vehicle according to claim 1, wherein said motor drive means includes an axle shaft having a pinion gear axially joined thereto intermediate the ends of said shaft, said one wheel being fixedly joined to one end of said shaft and said other wheel being mounted for pivotal movement about the other end of said shaft, and a motor mounted to said body having a driving gear for operatively engaging said pinion gear.

* * * * *